United States Patent [19]

Chiesa, Jr.

[11] 4,387,032

[45] * Jun. 7, 1983

[54] CONCENTRATES FOR FIRE-FIGHTING FOAM

[75] Inventor: Peter J. Chiesa, Jr., South San Francisco, Calif.

[73] Assignee: Enterra Corporation, Lionville, Pa.

[ * ] Notice: The portion of the term of this patent subsequent to Nov. 29, 1994, has been disclaimed.

[21] Appl. No.: 214,260

[22] Filed: Dec. 8, 1980

Related U.S. Application Data

[63] Continuation-in-part of Ser. No. 17,858, Mar. 6, 1979, which is a continuation-in-part of Ser. No. 808,462, Jun. 21, 1977, Pat. No. 4,149,599, which is a continuation-in-part of Ser. No. 670,252, Mar. 25, 1976, Pat. No. 4,060,489, said Ser. No. 557,757, Mar. 12, 1975, Pat. No. 4,060,132, and Ser. No. 525,175, Nov. 19, 1974, Pat. No. 4,038,195, each is a continuation-in-part of Ser. No. 369,584, Jun. 13, 1973, Pat. No. 3,957,657, said Ser. No. 557,757, Ser. No. 525,175, and Ser. No. 369,584, each is a continuation-in-part of Ser. No. 307,479, Nov. 17, 1972, abandoned, said Ser. No. 525,175, Ser. No. 369,584, and Ser. No. 307,479, each is a continuation-in-part of Ser. No. 254,404, Nov. 18, 1972, Pat. No. 3,849,315, said Ser. No. 369,584, Ser. No. 307,479, and Ser. No. 254,404, each is a continuation-in-part of Ser. No. 131,763, Apr. 6, 1971, abandoned.

[51] Int. Cl.[3] ..... A62D 1/00

[52] U.S. Cl. ..... 252/3; 252/8.05; 252/307; 252/363.5; 169/44; 169/46; 169/47

[58] Field of Search ..... 252/3, 8.05, 307, 316, 252/363.5; 169/44, 46, 47; 536/1

[56] References Cited

U.S. PATENT DOCUMENTS

| | | | |
|---|---|---|---|
| 2,088,085 | 7/1937 | Gross et al. | 252/6 |
| 3,915,800 | 10/1975 | Kang et al. | 252/3 |
| 4,060,489 | 11/1977 | Chiesa, Jr. | 252/3 |
| 4,149,599 | 4/1979 | Chiesa, Jr. | 252/3 |

*Primary Examiner*—John Kight, III
*Assistant Examiner*—Nathan M. Nutter
*Attorney, Agent, or Firm*—Connolly and Hutz

[57] ABSTRACT

Fire-fighting foam effective against burning hydrophilic or polar liquids like lower alcohols, ketones, etc. is made from concentrate containing thixotropic thickener dissolved in large amount, up to 1.5% or more, yet has a tolerable viscosity so that it can be poured or pumped. Heteropolysaccharide-7 or chain-shortened modifications of it are particularly suitable for this purpose. Higher concentrations are made practical by including in the concentrate urea, thiourea, ammonium cyanate or ammonium thiocyanate, to reduce the concentrate's viscosity and keep the polysaccharide from separating out upon freezing. Magnesium salts can also be dissolved in concentrate to improve fire extinguishing action when diluted with fresh water.

4 Claims, No Drawings

CONCENTRATES FOR FIRE-FIGHTING FOAM

This application is a continuation-in-part of application Ser. No. 17,858 filed Mar. 6, 1979, which is a continuation-in-part of application Ser. No. 808,462 filed June 21, 1977 (U.S. Pat. No. 4,149,599 granted Apr. 17, 1979), which in turn is a continuation-in-part of applications Ser. No. 670,252 filed Mar. 25, 1976 (U.S. Pat. No. 4,060,489 granted Nov. 29, 1977), Ser. No. 557,757 filed Mar. 12, 1975 (U.S. Pat. No. 4,060,132 granted Nov. 29, 1977) and Ser. No. 525,175 filed Nov. 19, 1974 (U.S. Pat. No. 4,038,195 granted July 26, 1977), each of which is in its turn a continuation-in-part of prior application Ser. No. 369,584 filed June 13, 1973 (U.S. Pat. No. 3,957,657 granted May 18, 1976). Applications Ser. Nos. 557,757, 525,175 and 369,584 are also continuations-in-part of earlier application Ser. No. 307,479 filed Nov. 17, 1972 (subsequently abandoned); while applications Ser. Nos. 525,175, 369,584 and 307,479 are each continuations-in-part of still earlier application Ser. No. 254,404 filed May 18, 1972 (U.S. Pat. No. 3,849,315 granted Nov. 19, 1974); and applications Ser. Nos. 369,584, 307,479 and 254,404 are each continuations-in-part of parent application Ser. No. 131,763 filed Apr. 6, 1971 (subsequently abandoned).

The present invention relates primarily to the fighting of fires on hydrophilic liquids.

Among the objects of the present invention is the provision of novel compositions with which to fight such fires, as well as novel techniques for making such compositions.

These as well as further objects of the present invention are discussed in the following description of several of its exemplifications.

The fighting of fires on hydrophilic liquids such as isopropyl alcohol, acetone, and the like, is more awkward than the fighting of fires on hydrophobic liquids. Aqueous foams are considered the most desirable materials for fighting fires on large bodies of flammable liquids, and applicant's earlier patent applications show that the presence of a thixotropic polysaccharide in dissolved condition in the aqueous liquid from which the foam is prepared, causes the foam to gel and become a bubble-containing mat when it contacts the hydrophilic liquid. Such mat floats on the burning liquid and protects the foam above it so that the fire is fairly rapidly extinguished.

Because the foams are generated by foaming an aqueous concentrate that is diluted with many times its volume of water, the concentration of the thixotropic polysaccharide in the diluted solution is quite small so that it is difficult to develop a very good, stable mat formation. Moreover it is not too practical to merely dissolve a very high concentration of the thixotropic polysaccharide in the aqueous concentrate, inasmuch as this generally produces a concentrate that is too stiff a gel to be rapidly diluted to foaming dilution or to be suitable for use with the proportioning foamers that have been developed. The solution of the thixotropic polysaccharide in the concentrate is colloidal in nature and the concentrate resembles a broken-gel although it is pourable as well as pumpable and is readily inducted into the suction inlet of a venturi-type proportional diluter.

According to the present invention very desirable fire-fighting concentrates are in the form of colloidal solutions essentially in water, containing high concentrations of thixotropic polysaccharide thickener. So long as the concentrate is pourable, the higher the concentration of the polysaccharide thickener the greater the fire-fighting effectiveness and the more the concentrate can be diluted with water to make the fire-fighting foam. More dilution means less concentrate and less concentrate storage is needed to provide the same quantity of diluted liquid.

Particularly desirable thixotropic polysaccharides are heteropolysaccharide-7 described in U.S. Pat. No. 3,915,800, as well as somewhat degraded forms of heteropolysaccharide-7. Among other advantages these polysaccharides yield more effective foams when the concentrates are diluted with sea water, as compared to fresh water.

Some working examples illustrate the present invention.

EXAMPLE 1

The following ingredients are combined:

| | |
|---|---|
| Water | 9,240 ml. |
| Chlorinated metaxylenol | 3.6 g. |
| Urea | 93 g. |
| 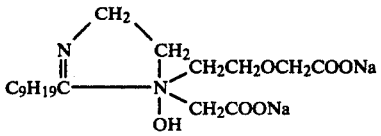 | |
| (30% in water) | 357 ml. |
| Heteropolysaccharide-7 | 122 g. |
| 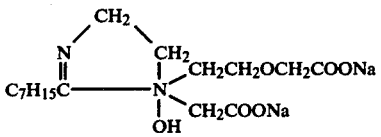 | |
| (30% in water) | 675 ml. |
| 30% aqueous solution of equimolecular mixture of sodium decylsulfate and sodium octylsulfate | 795 ml. |
| Monobutyl ether of diethylene glycol | 300 ml. |
| 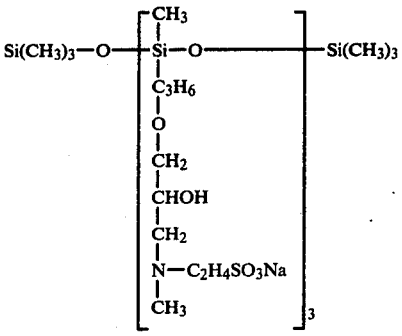 | |
| (40 weight percent in 1:1 isopropanol-water mixture by volume) | 213 ml. |
| $(CF_3)_2CF(CF_2)_nCOO^{-}{}^{+}NH_3C_2H_5$ where 20% of the n is 2, 30% of the n is 4, 30% of the n is 6, and 20% of the n is 8 | 102 g. |
| $MgSO_4$ | 204 g. |

The heteropolysaccharide-7 is difficult to dissolve directly in water in the above-specified amount, and it is preferred to begin by mixing together the first five ingredients, using only 12 ml. of the fourth ingredient (the $C_9$-substituted imidazoline) and adding the fifth in small portions with stirring, followed by pumping this pre-mix through a recirculating pump until smooth. The remaining ingredients are then added and the resulting mixture thoroughly mixed. Its pH should be about 7.1 to 8, and if necessary it is adjusted to that pH with acetic acid or ammonia. Upon completion of the stirring associated with the mixing, the product rapidly sets up to gel-like character, but is pourable and easily liquefied by a little agitation. With a bit of stirring it flows fairly easily. Under the influence of a suction of several inches of mercury produced at the intake of a venturi jet, the set-up product flows smoothly up into such a suction intake.

When the foregoing concentrate is diluted with ten times its volume of water it is readily foamed with air to produce a very effective firefighting foam having an expansion of 6 to 8. When foamed with the apparatus of U.S. Pat. No. 2,868,301 the foam can be projected a substantial distance. Projected onto a burning liquid as hydrophilic or as polar as ethanol or acetone, the majority of foam thus applied is not broken but some forms a gel-like mat that does not dissolve in such liquid rapidly enough to significantly diminish the spreading of the projected foam over the burning surface and the extinguishing of the fire by the foam. The formation of the mat involves gelation of the liquid contained in the foam and loss of water from the gelled liquid to the hydrophilic liquid through syneresis, and takes place so rapidly that the foam bubbles are trapped in the mat causing it to float on the hydrophilic liquid. This action takes place with about equal effectiveness when the diluting water is tap water or sea water or any combination of these two waters, and resulting diluates have about the same fire-fighting effectiveness.

Also when used to fight fires on hydrophobic liquids, the foregoing foam shows about the same good results as the well-known foams that do not contain thixotropic polysaccharide.

EXAMPLE 2

The formulation of Example 1 is modified in two respects. Instead of the 122 grams of heteropolysaccharide-7, there is added 138 grams of degraded form of that polysaccharide, and instead of 102 grams of the ethylammonium salt of the perfluorinated mixed acids, 100 grams of the free mixed acids $CF_3(CH_2)_mCOOH$ are used, where 40% of the m is 4, 35% of the m is 6, and 25% of the m is 8.

The degraded form of the polysaccharide is prepared by adding a little HCl to the fermentation broth in which it is formed to bring its pH to 6.5, and then heating the acidified broth to 90° C. for thirty minutes. The degraded product is then recovered by the same technique used to recover the undegraded material.

Other hydrolysis techniques can be used to degrade the fermentation product if desired. Alternatively degradation can be effected by heat alone or by oxidative attack. Thus a one-hour boiling of the fermentation broth causes degradation, or the fermentation broth can be treated with 1/20 its volume of 30% $H_2O_2$ at 70° C. for 30 minutes, and a similar degradation can be effected with 1/10 its volume of acidified 2% potassium permanganate at 50° C. The degradation is not major and the degraded product is still quite insoluble in lower alcohols so that the recovery technique does not have to be modified. It is estimated that the degrading step shortens the polymer chains about twenty to thirty percent and has no other significant effect. The viscosity of a 1% aqueous solution of the polymer at low shear is generally reduced about $\frac{1}{3}$, and this is the important result that is desired.

Because of the viscosity reduction the formulation of Example 2 contains more of the polysaccharide and when diluted and foamed it is somewhat more effective in extinguishing fires on hydrophilic liquids. Thus when a typical concentrate of Example 2 has its viscosity measured with a Brookfield LVF viscometer using a No. 4 spindle, it gives the following readings at the designated spindle speeds:

| Spindle Speed in Revolutions per Minute | Viscosity in Centipoises |
|---|---|
| 0.3 | 142,000 |
| 0.6 | 95,000 |
| 1.5 | 53,600 |
| 3.0 | 32,000 |
| 6.0 | 17,700 |
| 12.0 | 9,450 |
| 30.0 | 4,200 |
| 60.0 | 2,330 |

Because the 60 rpm viscosity is below 3000 centipoises, such a concentrate is well suited for use with standard proportioning foamers. Because of the high content of the polysaccharide, over 1.1% by weight of the concentrate, it can be diluted with more than 10 times its volume of water and still do a very good job of extinguishing fires. A typical fire test gives the following results on a burning batch of 60 gallons 99% isopropyl alcohol in a round pan providing a 40 square foot surface.

| | |
|---|---|
| Preburn time | 3 minutes |
| Dilution | with $16\frac{2}{3}$ its volume of tap water (6%) |
| Application rate | 0.15 gallons of diluate per minute per square foot of surface |
| Expansion | 8.8 |
| Control | 2 minutes 20 seconds |
| Extinguishment | 2 minutes 50 seconds |
| Sealability (the application of the foam is continued for 1 minute after extinguishment) | 11 minutes 30 seconds |

This appears to be largely due to the presence of magnesium ions in sea water, and the addition of magnesium ions in the foregoing formulations in a proportion of at least about 1/6 the weight of the polysaccharide, shortens their fire extinguishing times when they are diluted with fresh water. It has no significant effect on the fire extinguishing when sea water is the diluent.

Increasing the magnesium ion content to about $\frac{1}{3}$ the weight of the polysaccharide heightens the improvement, but further increases in magnesium ion content do not further add significantly to the effectiveness.

Adding too much magnesium ion can also produce problems such as the precipitation of magnesium compound when the concentrate is subjected to very low temperatures. Such precipitation could interfere with the use of the concentrate in standard proportioning foamers in extremely cold weather. Magnesium sulfate in a proportion of about 1.3 to about 1.7 times the weight of the polysaccharide is a preferred choice and gives magnesium ions in a proportion of about ¼ to about ⅓ the weight of the polysaccharide. However, magnesium chloride, nitrate, and/or acetate can be substituted for some or all of the magnesium sulfate, if desired. Other metallic ions such as of calcium, chromium and the others listed in U.S. Pat. No. 3,915,800 (Table VII) can be substituted for the magnesium but are not as good at equalizing the effects of sea water and fresh water dilution.

The urea in the foregoing examples renders the concentrates freeze-thaw stable and also reduces their viscosities. Urea had also been found to speed up the solution of some batches of the polysaccharide in the water. Other batches do not appear to similarly increase their dissolving rates, although they do form freeze-thaw stable and less viscous concentrates, when the urea is added. For the degraded forms of heteropolysaccharide-7 the optimum urea content of the water in which the polysaccharide is to be dissolved is not as high as for undegraded heteropolysaccharide-7. From about ½% to about 5% urea in the water, by weight, is a preferred range of concentration regardless of the type of heteropolysaccharide-7, and the same concentration is suitable for other viscosity-increasing thickeners such as scleroglucan, mannan gum, etc. Even lesser concentrations of urea make themselves felt, but about 1.5% gives the best results.

The urea also helps reduce the freezing point of the concentrate, as mentioned in British Patent Specification 1,126,027. As little as ½% urea based on the weight of the concentrate produces a noticeable improvement, particularly when the concentrate also contains at least about 2% of a glycol or an etherified glycol freezing point depressant.

The urea can be partially or completely replaced by thiourea or even ammonium thiocyanate or ammonium cyanate, without much change in effectiveness. A stabilizing effect of urea and thiourea has been noted in German Auslegeschrift No. 1,169,302 and in U.S. Pat. No. 2,088,085, but these references do not suggest viscosity reduction for the very highly viscous solutions, or freeze-thaw stability.

The diethylene glycol monobutyl ether in the above examples can also be omitted, although it helps boost the expansion obtainable when the concentrate is foamed, and also helps shorten the time required to extinguish a fire, particularly on hydrophilic liquids. Only about 2 to 5% of such additive based on the total weight of the concentrate is all that is needed for this purpose. This additive also helps reduce the freezing point of the concentrate, but this is not important. The concentrates of the present invention are freeze-thaw stable so that they are not damaged by freezing, and as they cool to freezing temperature their gel-like condition becomes too stiff before they actually freeze. They should accordingly be stored for use at temperatures no lower than about 35° F., unless the concentrates are to be pumped through a diluting apparatus by a positive displacement pump.

The concentrates withstand many cycles of freezing and thawing without apparent change. On the other hand, without the urea, corresponding concentrates have a heavy polysaccharide-containing layer separate out after one or two freeze-thaw cycles, and cannot be used then without thorough mixing.

It will be further noted that the dissolved magnesium salt significantly reduces the freezing point of the concentrates, whether or not other freeze-preventing additives are used. Additives such as ethylene glycol and hexylene glycol can be used in place of some or all of the diethylene glycol monobutyl ether, if desired, but are not preferred inasmuch as they are considered somewhat more toxic to marine life and fire-fighting liquids can eventually run off into streams. However any glycol, polyglycol or monoalkyl ether of such glycol or polyglycol having not over 10 carbons in its molecule will improve the pourability of the concentrate.

The silicone surfactant and/or the fluorocarbon surfactant can also be omitted if desired. As noted in applicant's earlier applications, their presence makes the formulations, after dilution and foaming, extremely effective in extinguishing fires on hydrophobic liquids such as gasoline, so that these formulations can be used for fighting fires involving either type of liquid with excellent results. The silicone surfactant and the fluorocarbon surfactant cause aqueous films to form over burning hydrophobic liquids, and this greatly assists the fighting of fires on such liquids. However, either of these two aqueous film formers can be reduced in quantity or entirely eliminated, and good aqueous film formation generally effected by increasing the concentration of the other. Also as pointed out in applicant's earlier applications other fluorocarbon surfactants and other silicone surfactants can be used to provide the aqueous film formation. For such result the diluted concentrate should have a surface tension of 19 or less dynes per centimeter, preferably 18 dynes or less. Higher surface tensions do not cause significant aqueous film formation.

The omission of all fluorocarbon surfactant from the foregoing formulations also lowers the effectiveness with which they fight fires on hydrophilic liquids. At least about 0.4% fluorocarbon surfactant, or better still 0.6% is particularly desired to give such increased effectiveness to concentrates that are subject to a 6% dilution before foaming.

The formulation of Example 2 with its relatively high concentration of thixotropic polysaccharide does a very good job of extinguishing fires on hydrophilic liquids, even when diluted with 16⅔ times its volume of fresh or sea water. On the other hand the formulation of Example 1 is best used when diluted with only about 10 times its volume of fresh or sea water.

The formulations of both examples do not include the resinous film-formers normally used in foam concentrates as described in applicant's earlier applications. Such film-formers can be added as for instance in concentrations that add about ½% to about 1½% solids based on the total weight of the concentrate. A particularly good resinous film-former is the reaction product of 3-dimethylaminopropylamine-1 with an equivalent amount of ethylenemaleicanhydride copolymer, described in Example I of British Pat. No. 1,381,953 and column 8 of U.S. Pat. No. 3,957,657. Other film formers such as water-soluble gums and even polyacrylic acid can be used.

The chlorinated metaxylenol of the formulations of the present examples is a biocide that prevents the growth of mold, bacteria, etc. in the concentrates. Other biocides or preservatives, such as methyl parahydroxybenzoate or any of these designated in the prior applications can be used instead of or combined with the chlorinated metaxylenol, preferably in a total concentration of 0.01 to about 0.3% by weight of the concentrate. When the concentrate is made by a sequence of steps extending over a number of hours, as for instance when the polysaccharide solution in the water is prepared and stirred or permitted to stand overnight before the remaining ingredients are added, the preservative should be added in the first stage of the preparation.

The formulations of Examples 1 and 2 not only have fluorocarbon and silicone surfactants in small amounts but they also have additional surfactants that are not of the fluorocarbon or silicone types and are in larger amounts to impart the desired foamability to the compositions. Those foamability-improving surfactants are largely of the type that have a hydrophilic moiety weighing at least 80% more than the lipophilic moiety, and thus follow the teachings of applicant's earlier U.S. Pat. No. 3,849,315.

The foamed compositions of the present invention do a very good job of extinguishing fires when applied by projection from foam-delivering nozzles, either portable or fixed as for example on towers, or from line-proportioning foamers, or foam chambers. In each case standard equipment can be used without modification.

The formulation of Example 2 meets all commercial standards when used to extinguish fires after dilution with 16⅔ times its volume of fresh or sea water, which is a standard dilution provided by standard foaming equipment. At this dilution it is preferred to apply it to fires on the following liquids at the designated rates in gallons of diluted liquid per minute per square foot of surface on the burning liquid, using a fixed applicator such as a foam chamber:

| | |
|---|---|
| Methanol | .16 |
| Isopropanol | .20 |
| n-Propanol | .10 |
| n-Butanol | .10 |
| t-Butyl Alcohol | .35 |
| Isodecanol | .10 |
| SDA-1-200 PF (Ethanol) | .16 |
| Ethyl Acetate | .10 |
| n-Propyl Acetate | .10 |
| Butyl Acetate | .10 |
| Methyl Amyl Acetate | .10 |
| Methyl Acrylate | .10 |
| Acetone | .20 |
| Methyl Ethyl Ketone | .20 |
| Methyl Isobutyl Ketone | .10 |
| Propionaldehyde | .10 |
| Hexane | .10 |
| Heptane | .10 |
| Automotive Gasoline | .10 |
| Lactol Spirits (Naptha Solvent) | .10 |
| Mineral Spirits (Petroleum Spirit) | .10 |
| Toluene | .10 |
| Petroleum Distillate | .10 |
| Methyl Cellosolve | .10 |

The foregoing application rates are preferably increased by about one-fourth when using movable discharge nozzles to spread the applied foam and speed the extinguishment. However, it is not necessary to increase the rate of application to t-butyl alcohol (on which fires are always difficult to extinguish), or for any liquid to have a movable nozzle application rate less than about 0.16 gallons per minute per square foot.

The formulations of Examples 1 and 2 can be applied when diluted with 10 times their volume of fresh or sea water. The preferred application rates of the Example 2 formulation when so diluted are about one-fifth less than listed above, except that application rates lower than about 0.10 gallons per minute per square foot are not desirable whether from fixed or movable foam applicators. Also the tenfold dilution is not recommended for fires on hydrophobic liquids where the 16⅔ dilution has been a time-honored and widespread standard proven to be highly effective and built into standard fire-fighting equipment.

The formulations of the present invention can be further varied. Thus the formulation of Example 2 can use the fluorinated surfactant of Example 1, or major variations can be made such as shown in the following exemplifications:

EXAMPLE 3

In this example some of the heteropolysaccharide-7 is replaced by xanthan gum and good results are obtained, although there is some loss of burnback resistance. The formulation is

| | |
|---|---|
| water | 6155 mls. |
| urea | 62 g. |
| the degraded heteropolysaccharide-7 of Example 2 | 41 g. |
| xanthan gum | 41 g. |
| o-phenoxy phenol | 5.8 g. |
| the $C_9$ substituted imidazoline surfactant solution of Example 1 | 460 mls. |
| the mixed alcohol sulfates solution of Example 1 | 530 mls. |
| the silicone surfactant solution of Example 1 | 142 mls. |
| the fluorinated surfactant of Example 1 | 68 g. |
| acetic acid | 35 mls. |

The formulation of Example 3 can also be modified by the addition of 0.3% tris-hydroxymethyl aminomethane, about 0.07% of the disodium salt of nitrilotriacetic acid, and about 3% butyl carbitol, based on the total weight of concentrate.

Other very effective mixtures of perfluorocarboxylic acids useful for the formulations of the present invention, are those in which by weight about 55 to about 70% is $C_8$, about 14 to about 23% is $C_{10}$, about 6 to about 9% is $C_{12}$, about 2 to about 7% is $C_{14}$, and any balance is $C_6$. Such a mixture in a concentration of 30 grams/gallon in a formulation also having 25 grams/gallon of the silicone surfactant solution of Example 1 and 600 mls./gallon of the mixed imidazolines of Example 1, 150 mls./gallon of 30% solution of the corresponding $C_{11}$-substituted imidazoline surfactant, 295 mls./gallon of propylene glycol monobutyl ether and 268 mls./gallon of butyl cellosolve, makes a very effective fire extinguisher for hydrophobic liquids whether or not the heteropolysaccharide-7 is added to it.

Instead of degrading the normal polymeric chains of heteropolysaccharide-7, their formation by fermentation can be stopped when it has proceeded about half to three-quarters the extent practiced to produce the undegraded heteropolysaccharide-7. This early termination lowers the yield but also produces a shorter polymer that can be considered a degraded form of heteropolysaccharide-7 in accordance with the present invention. The undegraded polymer seems to resist degradation by high-shear stirring.

As shown, non-thixotropic thickeners for aqueous systems can also be used in small amounts in the formulation of the present invention. Locust bean gum can be used in an amount about $\frac{1}{3}$ that of the thixotropic polysaccharide. Some thickeners such as guar gum and its derivatives impart to the concentrates a freeze-thaw instability that is not desired.

N-methyl pyrrolidone-2 and other liquid amides such as dimethyl formamide, and organic compounds containing a nitrogen atom in the molecule, such as acetonitrile and triethylamine, have special solubilizing effects on thixotropic polysaccharides and when the thixotropic polysaccharide is mixed with these liquids before being stirred in water, the development of a froth is sharply reduced or completely prevented. In addition these liquids reduce the viscosity of the concentrate in which they are present. N-methyl pyrollidone-2 is preferred for this purpose because of its effectiveness and low toxicity. However, it has an adverse effect on fire fighting with heteropolysaccharide-7 or its degraded forms, and is best used with scleroglucan as the thixotropic polysaccharide.

These solubility modifiers can be used in very small amounts to enable the simple and inexpensive manufacture of concentrates containing as much as 1.5% or more of the thixotropic polysaccharide by weight. This is shown in the following example.

EXAMPLE 4

A very concentrated slurry of degraded heteropolysaccharide-7 is prepared by slowly stirring 590 grams of this polysaccharide in dry powder form into an anhydrous solution of 300 milliliters N-methyl-pyrollidone-2 in 850 milliliters of butyl carbitol. Only a few minutes of vigorous agitation is needed to obtain a milky slurry that pours readily and is highly effective in dissolving in water to make aqueous fire-fighting concentrates having large contents of the polysaccharide. This dissolving action is also speeded up by the presence in the water of the urea or thiourea or ammonium cyanate or ammonium thiocyanate, and the slurry dissolves very rapidly in such a solution.

Thus the foregoing slurry is poured slowly, with agitation into a previously prepared solution in 30.5 liters tap water of 480 grams urea and 40 ml. of 30% commercial grade imidazoline di-carboxylate having the attached $C_9H_{19}$ group as in Example 1. This solution preferably also contains a small amount of preservative such as 111 grams of p-phenoxy phenol. Stirring is continued for about 3 hours after the slurry is completely introduced and the container in which the slurry was prepared is washed with 150 ml. of butyl carbitol, the washings being poured into the solution to make sure all the heteropolysaccharide-7 is transferred.

The resulting batch is permitted to stand overnight, following which about two more hours of stirring leaves it as a very smooth colloidal solution free of undissolved solid and of lumps, and ready to receive the remaining ingredients. A separately prepared mixture of 476 grams of the fluorocarbon surfactant of Example 1, 424 ml. of the silicone surfactant of Example 1, 1.15 liters of the foregoing imidazoline dicarboxylate, 2.25 liters of 30% commercial grade second imidazoline dicarboxylate of Example 1, and 3.05 liters of the mixed sodium decylsulfate and octylsulfate of Example 1, is then poured into the colloidal solution, the resulting mixture stirred for about a half hour and 545 grams of magnesium sulfate added. About one hour of stirring at this point brings the combination into its final form ready for use. For storage, its pH is best adjusted to 7.4±0.1 with acetic acid, and 57 grams of 30% aqueous formaldehyde added. About 10 gallons of very effective concentrate is thus produced. Because it contains a little over 1.5% thixotropic polysaccharide it is more effective than the concentrate of Example 1 in fighting fires on hydrophilic liquids.

It is also helpful to buffer this concentrate as by the addition of some tris-hydroxymethyl aminomethane in a quantity of $\frac{1}{8}$ to $\frac{1}{2}$% by weight, unless the silicone surfactant is omitted.

The foregoing nitrogen-containing compounds can be diluted with up to about 3 times their weight of a glycol, a polyglycol, or a monoalkyl ether of such glycol or polyglycol, the diluent having not more than 10 carbon atoms in the molecule, for the improved solubilizing action. Best solubilizing is obtained when these nitrogen-containing compounds, either undiluted or diluted as above, are in anhydrous condition when first mixed with the thixotropic polysaccharide.

A similar improvement in solubilizing action and froth diminution is obtained when butyl carbitol or other preferably anhydrous monoalkyl ether of a glycol or polyglycol containing from 6 to 10 carbon atoms in the molecule is used alone to slurry the thixotropic polysaccharide, providing the weight of the slurrying liquid is at least twice that of the polysaccharide. Thus the slurrying liquid mixture of Example 4 can be replaced by 1150 milliliters of anhydrous butyl carbitol and will produce a polysaccharide-containing slurry that dissolves about as well as that of Example 4.

The concentrates of the present invention can be stored in mild steel containers that have their interiors uncoated, or in plastic containers. No serious corrosion of the mild steel is produced after many months of storage in such a container. They can be used very effectively to fight non-polar liquid fires in tanks by introducing the foamed diluted concentrate below the liquid surface in the tank. This so-called sub-surface introduction technique is particularly desirable in tanks of gasoline or other petroleum products, and is not suitable for fighting fires on polar, that is hydrophilic, liquids.

As shown above, burning tertiary butyl alcohol is more difficult to extinguish with the compositions of the present invention than most other hydrophilic liquids generally encountered in fire-fighting. Organic compounds containing a nitrogen atom in the molecule, such as those referred to above as having solubility-increasing effects, are similarly quite difficult to extinguish and require substantial foam application rates.

Perfluorocarboxylic acids can be used in the formulation without first converting them to salts. Although substantially less water-soluble than their salts, these acids readily dissolve in the silicone surfactant ingredient which is supplied as a 40% by weight solution in a water-isopropanol mixture. Once dissolved in that ingredient the perfluorinated acids do not precipitate out upon addition of the remaining ingredients.

Any of the other fluorinated surfactants referred to in applicant's earlier patent applications can be used in place of perfluorocarboxylic acids, but perfluoro acids are particularly inexpensive and thus more desirable. Mixtures of perfluorooctanoic acid or similar long-chain perfluoro acids, with shorter chain perfluoro acids, are preferred, and such mixtures can be more economically manufactured, as can mixtures of silicone surfactants. The silicone surfactants can also be replaced by any of those referred to in applicant's earlier applications.

Similar considerations also apply to the imidazoline surfactants except that when these are manufactured by different processes they are sometimes more poisonous to fish. Such undesired side-effect appears to be due to by-products or contaminants introduced by the manufacture, inasmuch as carefully purified surfactants of this type have sharply reduced toxicity to fish. It is accordingly helpful to compare such surfactants with corresponding surfactants from other sources, if low fish toxicity is desired.

For dilution of any of the foregoing concentrates with sea water it is also helpful to use the perfluoroalkyl amino carboxylic acids of U.S. Pat. No. 4,038,195, in place of the simple perfluoro carboxylic acids. Of the various silicone surfactants disclosed in applicant's earlier applications, there is no significant advantage in any of them, and so the preference is to use the least expensive. Thus the first silicone surfactant described in column 1 of U.S. Pat. No. 3,957,657 can be substituted for the silicone surfactants of any of the foregoing examples.

Obviously many modifications and variations of the present invention are possible in the light of the above teachings. It is, therefore, to be understood that within the scope of the appended claims the invention may be practiced otherwise than as specifically described.

I claim:

1. In a pourable liquid fire-fighting concentrate containing (a) at least one foaming agent in a quantity that enables the formation of fire-fighting foam from the diluted concentrate, and (b) a colloidally dissolved thixotropic polysaccharide which causes the foam to form a gel mat when contacted with polar organic liquids, the improvement according to which the solvent for the concentrate is essentially water, the concentrate contains at least about 1.5% by weight of the colloidally-dissolved polysaccharide, and the polysaccharide is selected from the class consisting of heteropolysaccharide-7 and degraded forms of heteropolysaccharide-7.

2. The combination of claim 1 in which the concentrate also contains about ½% to about 5% by weight of urea, thiourea, ammonium cyanate or ammonium thiocyanate, and is freeze-thaw stable.

3. The combination of claim 1 in which the concentrate also contains magnesium ions in a quantity that improves its fire-fighting effectiveness when diluted with fresh water but does not detract from its fire-fighting effectiveness when diluted with sea water.

4. In a pourable liquid fire-fighting concentrate containing (a) at least one foaming agent in a quantity that enables the formation of fire-fighting foam from the diluted concentrate, and (b) a colloidally dissolved thixotropic polysaccharide which causes the foam to form a gel mat when contacted with polar organic liquids, the improvement according to which the concentrate contains about ½% to about 5% of urea, thiourea ammonium cyanate or ammonium thiocyanate, and withstands freeze-thaw cycling.

* * * * *